US006032502A

United States Patent [19]

Halasz et al.

[11] Patent Number: 6,032,502

[45] Date of Patent: Mar. 7, 2000

[54] APPARATUS AND METHOD FOR NECKING CONTAINERS

[75] Inventors: Andrew Halasz, Crystal Lake; Sylvan Praturlon, Oak Park, both of Ill.

[73] Assignee: American National Can Co., Chicago, Ill.

[21] Appl. No.: 09/144,590

[22] Filed: Aug. 31, 1998

[51] Int. Cl.[7] ..... B21D 41/04

[52] U.S. Cl. ..... 72/117; 72/94; 72/123

[58] Field of Search ..... 72/78, 94, 115, 72/117, 120, 122, 123, 124, 453.9

[56] References Cited

U.S. PATENT DOCUMENTS

| | | |
|---|---|---|
| D. 271,281 | 11/1983 | Abbott . |
| 2,194,385 | 3/1940 | Dove ..... 72/120 |
| 3,029,507 | 4/1962 | Gaggini . |
| 3,173,174 | 3/1965 | Edwards . |
| 3,468,153 | 9/1969 | Patarini . |
| 3,593,559 | 7/1971 | Hinshaw . |
| 3,680,350 | 8/1972 | Pavleszek . |
| 3,687,098 | 8/1972 | Maytag . |
| 3,771,476 | 11/1973 | Heinle . |
| 3,831,416 | 8/1974 | Wolfe . |
| 3,898,828 | 8/1975 | Cassai . |
| 3,913,366 | 10/1975 | Nelsen . |
| 3,964,413 | 6/1976 | Saunders . |
| 4,091,648 | 5/1978 | McCaslin . |
| 4,173,883 | 11/1979 | Boik . |
| 4,261,193 | 4/1981 | Boik . |
| 4,266,685 | 5/1981 | Lee, Jr. . |
| 4,280,353 | 7/1981 | Murphy . |
| 4,316,375 | 2/1982 | Lee, Jr. . |
| 4,320,568 | 3/1982 | Herrod . |
| 4,341,103 | 7/1982 | Escallon . |
| 4,403,493 | 9/1983 | Atkinson . |
| 4,441,354 | 4/1984 | Bodega . |
| 4,457,158 | 7/1984 | Miller . |
| 4,502,308 | 3/1985 | Kelly . |
| 4,512,172 | 4/1985 | Abbott . |
| 4,519,232 | 5/1985 | Traczyk . |
| 4,527,412 | 7/1985 | Stoffel . |
| 4,563,887 | 1/1986 | Bressan . |
| 4,606,207 | 8/1986 | Slade . |
| 4,693,108 | 9/1987 | Traczyk . |
| 4,732,027 | 3/1988 | Traczyk . |
| 4,747,287 | 5/1988 | Azzaline . |
| 4,760,725 | 8/1988 | Halasz . |
| 4,774,839 | 10/1988 | Caleffi . |
| 4,781,047 | 11/1988 | Bressan . |
| 5,018,379 | 5/1991 | Shirai . |
| 5,105,973 | 4/1992 | Jentzsch . |
| 5,222,385 | 6/1993 | Halasz . |
| 5,249,449 | 10/1993 | Lee . |
| 5,297,414 | 3/1994 | Sainz . |
| 5,318,858 | 6/1994 | Johnson . |
| 5,325,696 | 7/1994 | Jentzsch . |
| 5,349,837 | 9/1994 | Halasz . |
| 5,353,619 | 10/1994 | Chu . |
| 5,355,710 | 10/1994 | Diekhoff . |
| 5,477,720 | 12/1995 | Lentz . |
| 5,497,900 | 3/1996 | Caleffi . |
| 5,524,468 | 6/1996 | Jentzsch . |
| 5,557,963 | 9/1996 | Diekhoff . |
| 5,755,130 | 5/1998 | Tung . |
| 5,775,161 | 7/1998 | Caleffi . |

*Primary Examiner*—Lowell A. Larson

[57] ABSTRACT

A die assembly includes spinning pilot rollers for necking-in the open end of a container. The die assembly includes a cylindrical die for engaging the outside surface of a container. A tubular spindle is rotatably mounted along the axis of the die. One or more of rollers are rotatably mounted on the spindle, and each roller is pivotable about an axis which extends parallel to the axis of the die. An actuator is reciprocably mounted within the spindle and is movable between first and second positions for camming the rollers away from the axis of the spindle and toward the inside surface of the die.

20 Claims, 13 Drawing Sheets

APPARATUS AND METHOD FOR NECKING CONTAINERS

BACKGROUND

This invention relates to an apparatus and method for necking smooth die-necked containers. More particularly, the invention uses spinning pilot rollers for necking the containers.

The invention is a modification of the necking apparatus which is described in U.S. Pat. Nos. 4,519,232, 4,774,839, and 5,497,900. As described in those patents, two-piece cans are the most common type of metal containers used in the beer and beverage industry and also are used for aerosol and food packaging. They are usually formed of aluminum or tin-plated steel. The two-piece can consists of a first cylindrical can body portion having an integral bottom end wall and a cylindrical side wall and a second, separately-formed, top end panel portion which, after the can has been filled, is double-seamed onto the can body to close the open upper end of the container.

In most cases, containers used for beer and carbonated beverages have an outside diameter of 2 11/16 inches (referred to as a 211-container) and are reduced to open end diameters of (a) 2 6/16 inches (referred to as a 206-neck) typically in a multiple-necking operation for a 206 end; or, (b) 2 4/16 inches (referred to as a 204 neck) typically in a multiple-necking operation for a 204 end; or, (c) 2 2/16 inches (referred to as a 202-neck) in a smooth multiple necking operation for a 202 end. Smaller diameter ends can be used, e.g., 200 or smaller, as well as larger diameters, e.g., 209 or 207.5.

As described in the '232, '839, and '900 patents, as the can passes through the apparatus after an initial operation, each of the die necking operations partially overlaps and reforms only a part of a previously-formed portion to produce a necked-in portion on the end of the cylindrical side wall until the necked-in portion extends the desired length. This process produces a smooth, tapered annular wall portion between the cylindrical side wall and the reduced diameter cylindrical neck portion. The tapered annular wall portion which has arcuate portions on either end may be characterized as the necked-in portion or taper between the cylindrical side wall and the reduced diameter neck.

Each container necking operation is performed in a necking module consisting of a turret which is rotatable about a fixed vertical axis. Each turret has a plurality of identical necking substations on the periphery thereof. Each necking substation includes a stationary necking die, a form control member which is reciprocable along an axis parallel to the fixed axis for the turret, and a platform or lifter pad which is movable by cams and cam followers.

An important competitive objective is to reduce the total can weight as much as possible while maintaining its strength and performance in accordance with industry requirements. Accordingly, to minimize the overall container weight, both the side wall and the end panel should be made as thin as possible without compromising the strength and performance of the can. For instance, a top wall thickness of 0.0054 inch in aluminum cans allows a considerable saving on material. However, existing apparatus has difficulty forming a smooth neck of such thickness. Further, it typically takes 16 die necking operations, with an inside can pressurization of 30 psi or more, to reduce the can diameter from a 211 body to a 202 end. The costs of the equipment and the operational costs offset the savings in material.

Spin necking is an alternate method for producing smooth neck configurations. However, it is well known that spin necking, either from the inside or outside of the can, can have problems with stretching and thinning the neck metal and thereby tends to weaken the neck. This stretching of the neck, while tolerable for wall thicknesses considerably larger than 0.0054 inch, is not acceptable for a thickness of 0.0054 inch or lower. Dimensional control of the neck is also an issue with spin necking.

Presently available die necking equipment requires a cylindrical pilot to guide the can edge during the necking operation. However, there is no guidance from the moment the can edge contacts the die to the moment the can edge contacts the pilot. Consequently, wrinkling of the can edge is likely to occur. This can be appreciated, for example, by referring to FIGS. 6–11 of U.S. Pat. No. 4,774,839. Between the time the upper edge of the can contacts the tapered necking portion 204 of the die and the time the can edge contacts the cylindrical pilot 150, the can edge is unsupported and the can wrinkles.

A way of overcoming the above problem is to reduce the gap between the initial can contact with the die and the pilot by increasing the number of necking operations. However, this is very expensive because each necking operation requires a separate necking station. Further, increasing the necking operations does not prevent the forming of minute wrinkles on the edge of the can. Such wrinkles are ironed out by forcing the edge of the can between the cylindrical upper portion of the die and the pilot. Failing to iron out these small wrinkles would allow them to grow in size as the can proceeds from operation to operation.

This ironing operation requires extreme dimensional control of both die and pilot diameters. The gap between the die and the pilot should be uniform around their entire circumferences, preferably about 0.0004 inch more than the thickness of the can wall. Also, forcing the edge of the can between die and pilot requires higher axial forces which tend to crush the body of the can or flatten the bottom of the can. Consequently, the can has to be pressurized to 30 or more psi with compressed air.

To prevent loss of control of the can edge, a pilot shaped over the entire inside profile of the die can be provided. However, once the neck is formed, the can cannot be removed from the pilot. Methods have been developed to expand a pilot during the necking operation to keep the edge of the can in contact with the die and to return the pilot to its original size for can removal. So far, such methods have not been successful for commercial production.

SUMMARY OF THE INVENTION

The present invention overcomes the difficulties described above by using retractable spinning rollers which provide a continuous surface for controlling the edge of the can at all times during the necking operation. The present process is not an inner spinning operation, because the can material is not spun or moved outwardly by the rollers.

The gap between the necking die inside surface and the virtual continuous surface generated by the spinning rollers is maintained at slightly more than the top wall metal thickness. The present design provides the high degree of accuracy required for maintaining the above mentioned gap within a narrow dimensional range, for example, the gap can be maintained at about 0.0059 to 0.0064 inch for a top wall thickness of 0.0054 inch.

A constant gap in which the edge of the can remains under control reduces friction between the inside surface of the neck and the rollers to a minimum. For example, when three rollers are used, only three line contacts exist at any instant in time. Consequently, there is no need of pressurizing the can for strength. Also, since there is no need of pushing the metal against the die, little friction exists between the inside surface of the die and the outer surface of the can neck after forming. Consequently, only about 6 psi of air pressure is needed to expel the can from the die.

The invention is particularly useful for thin top walls, i.e., having a thickness of about 0.0054 inch or less. The use of precisely controlled spinning rollers enables necking of thin walls to a 202 diameter in fewer necking operations, for example, 10 rather than 16, without wrinkling the container wall. Reducing the number of operations reduces the cost of the necking apparatus, reduces the amount of electrical power and compressed air which is required, and reduces space requirements.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
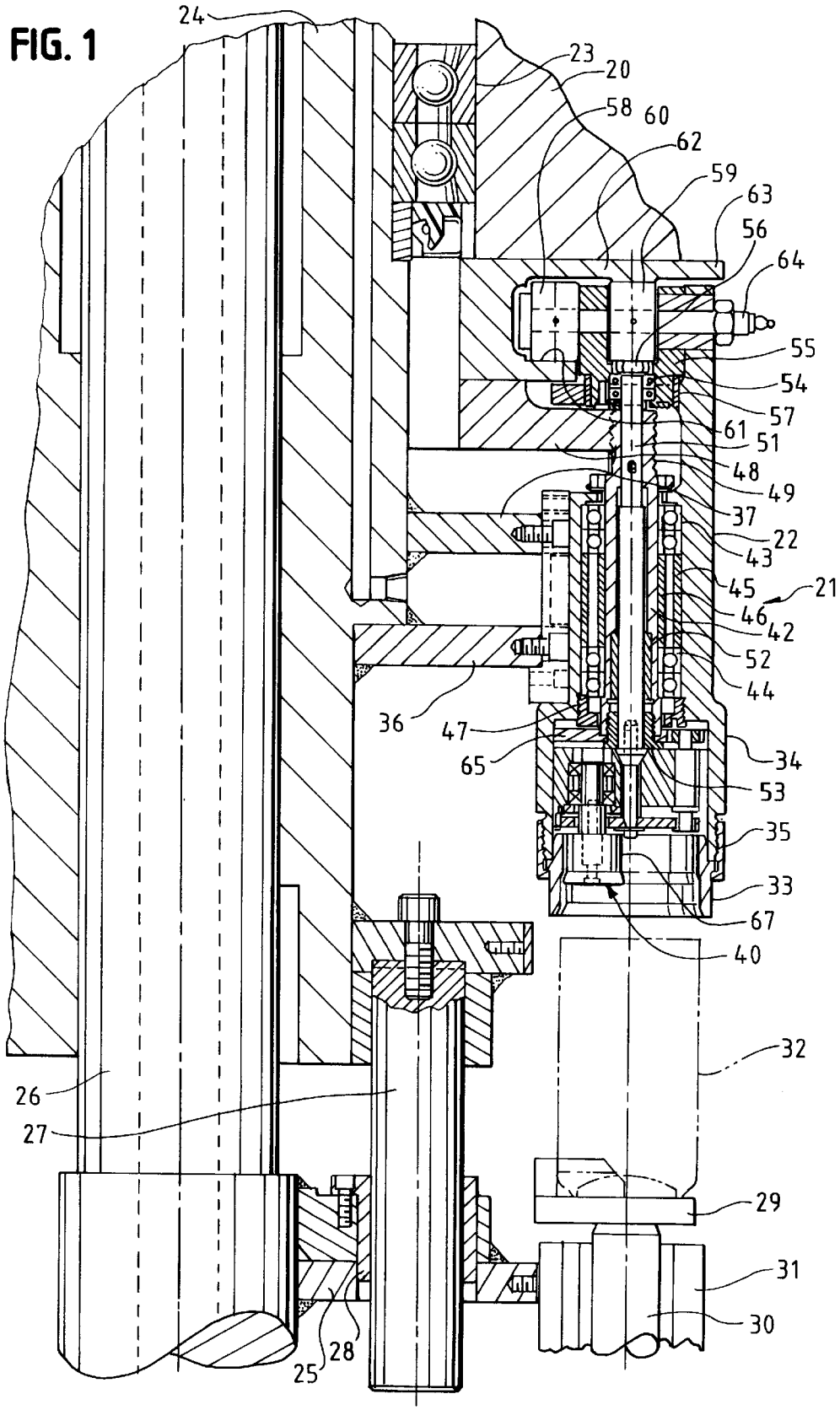
FIG. 1 is a fragmentary sectional view of a necking apparatus formed in accordance with the invention.

FIG. 1 illustrates one of the necking modules of a necking apparatus of the type which is described in U.S. Pat. Nos. 4,519,232, 4,774,839, and 5,497,900 but which has been modified in accordance with the invention. Except for the modifications which are described herein, the necking apparatus of this invention is substantially identical to the necking apparatus of the '232, '839, and '900 patents, and the disclosures of those patents are incorporated herein by reference.

Each necking module of the necking apparatus includes a stationary frame 20 and a rotary turret assembly 21 which is rotatably mounted on the frame and which holds a plurality of identical necking substations 22 around the periphery thereof. As described in the aforementioned patents, the turret assembly is rotatably supported on the stationary frame by upper bearings 23 and lower bearings (not shown).

An upper turret frame 24 and a lower turret frame 25 are supported on a central rotary drive shaft 26. The upper turret frame 24 is slidable axially on drive shaft 26 and is connected to the lower turret frame 25 for rotation therewith by a rod 27 which extends through a collar 28 on the lower turret frame.

A container lifter pad 29 is mounted on a ram or piston 30 which is reciprocably mounted in a cylinder 31 which is secured to the lower turret frame 25. As described in the '232, '839, and '900 patents, the lower end of the ram includes a cam follower which rides on a cam for raising and lowering the ram and the lifter pad 29. The lifter pad thereby moves a container or can 32 toward and away from the upper turret frame 24.

A necking die 33 is secured to an elongated tubular housing 34 by a threaded cap 35. The tubular housing 34 is mounted on the upper turret frame 24 by outwardly extending support brackets 36 and 37.

The form control members, pilots, or "knock-outs" of the aforementioned patents are replaced by one or more roller assemblies 40 inside of the die 33. Three roller assemblies 40 are shown in the embodiment illustrated in FIGS. 2 and 3. However, it is possible that only one roller assembly will be used as the size of the can end decreases.

The roller assemblies 40 are mounted on the lower end of a tubular spindle 42 which is rotatably mounted within the housing 34 by upper and lower angular contact bearings 43 and 44. The angular contact bearings eliminate axial movement of the spindle. The bearings are separated by cylindrical spacer sleeves 45 and 46, and the lower bearings 44 are supported by a bushing 47. The spindle is rotatably driven by a stationary gear 48 which is mounted on the stationary frame 20 and which engages gear teeth 49 on the spindle. As the turret assembly rotates on the frame 20, the spindle 42 is rotated by the gear 48. The gear ratio between the gear 48 and the gear teeth 49 is about 25 to 1, and the spindle is rotated at about 1000 to 4000 rpm, preferably at about 2500 to 3000 rpm, as the turret rotates.

An elongated actuator rod 51 is reciprocably mounted inside of the spindle 42 by cylindrical bushings 52 and 53. The upper end of the actuator is supported by angular contact bearings 54 which are mounted in a housing 55. A lock nut 56 is threaded onto the end of the actuator 51 and anchors the actuator and the bearings 54 relative to the housing 55.

The housing 55 is slidably mounted in a bushing 57 which is mounted on the outer housing 34. Inside and outside cam followers 58 and 59 are attached to housing 55 by a rod 60 which extends through the housing 55. Cam follower 58 engages a camming ramp 61, and cam follower 59 engages a camming ramp 62. The camming ramps are part of a cam housing 63 which is mounted on the stationary frame 20 of the necking apparatus.

The camming ramp 61 is used to move the actuator 51 upwardly, and the camming ramp 62 is used to move the actuator downwardly as the turret 21 rotates relative to the stationary frame 20 and the cam housing 63. A grease fitting 64 on the end of the tubular rod 60 permits lubrication of the cam followers. A pin extends transversely through a slot in the actuator for ensuring that the actuator rotates with the spindle 42.

Figure 2:
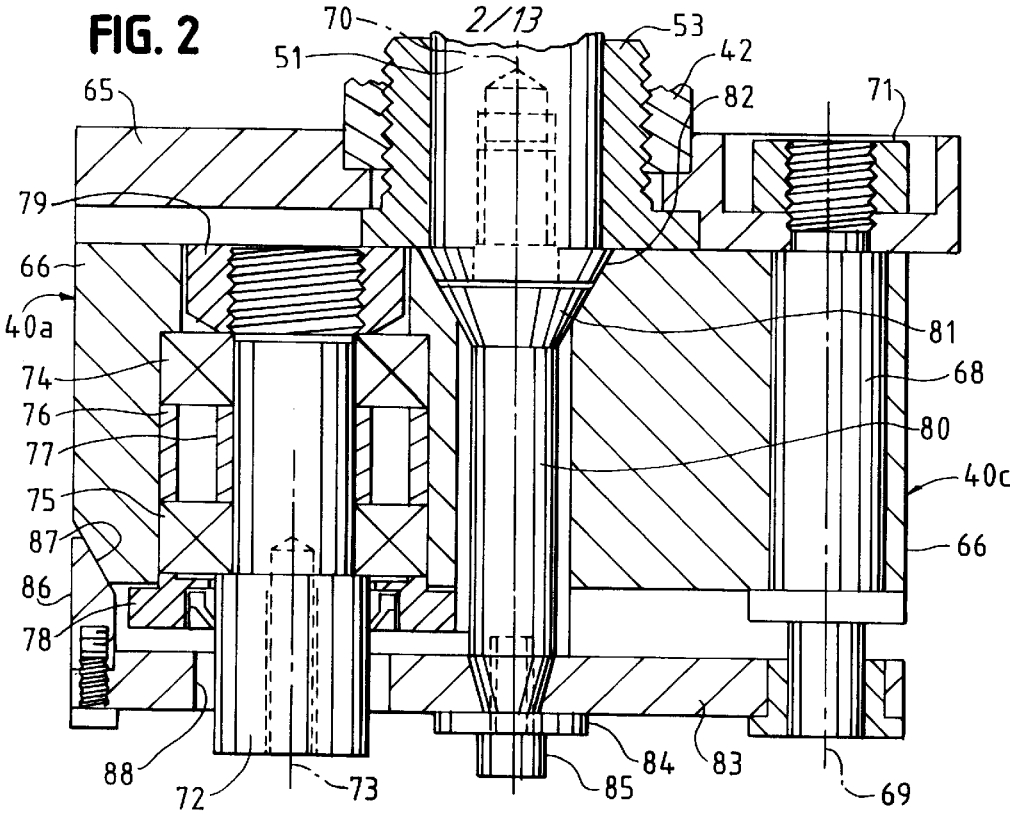
FIG. 2 is an enlarged sectional view of the roller assemblies (without the rollers) which are mounted on the lower end of the spindle.
Figure 3:
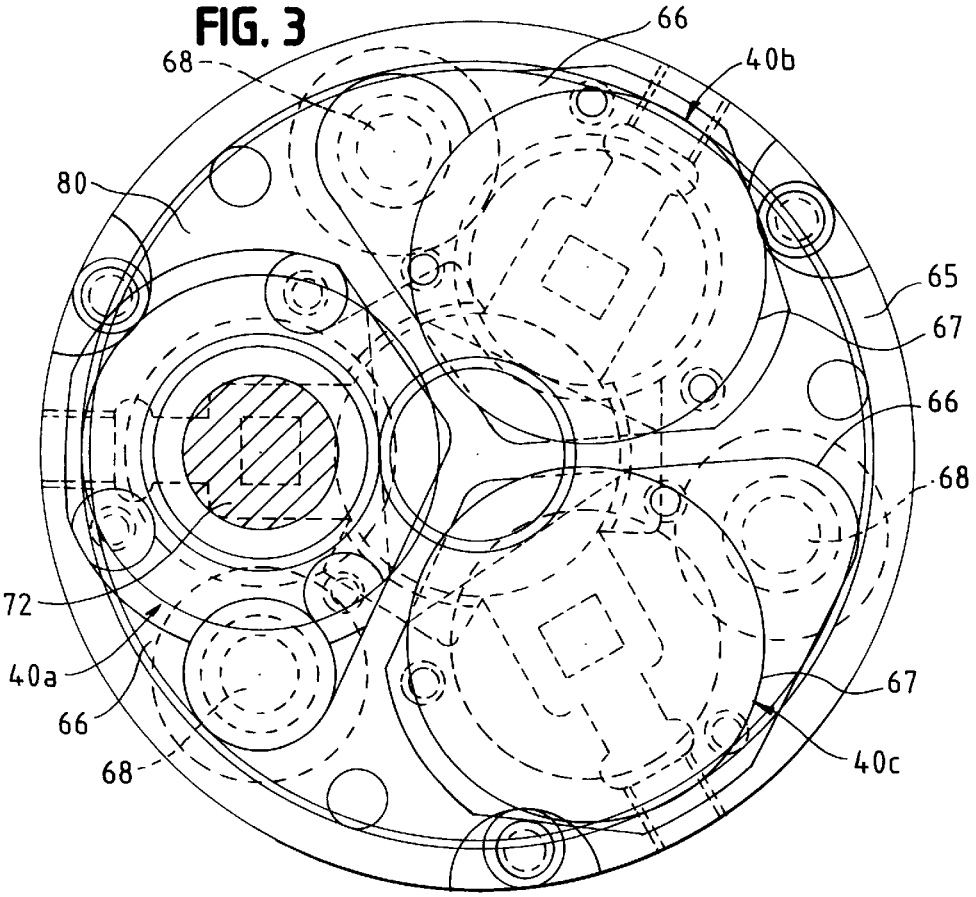
FIG. 3 is a bottom plan view, partially in section, of the roller assemblies of FIG. 2, including the rollers.

Referring to FIGS. 2 and 3, a mounting plate 65 is attached to the lower end of the spindle 42 for supporting the three roller assemblies 40*a*, 40*b*, and 40*c*. Each roller assembly includes a roller housing 66 and a pilot roller 67 (FIG. 1). The rollers are not shown in FIG. 2.

Each roller housing is pivotally attached to the mounting plate 65 by a pivot pin 68 which has an axis 69 which extends parallel to the axis 70 of the spindle 42. The upper end of the pivot pin extends through the mounting plate and is secured by a nut 71.

Each roller 67 is attached to a shaft 72 which is rotatably mounted on a spinning axis 73 by upper and lower angular contact bearings 74 and 75. The bearings are separated by spacer sleeves 76 and 77 and are retained in the housing by a cap 78. The shaft is retained in the bearings by a nut or cap 79 on the upper end of the shaft.

A camming pin 80 extends downwardly from the actuator 51 and includes a conical camming surface 81. The camming pin is engageable with an inclined camming surface 82 on each of the roller housings.

A cam plate 83 is attached to the lower end of the camming pin 80 by a washer 84 and a screw 85. Three cams 86 are attached to the top of the cam plate and project upwardly toward the roller housings. Each cam 86 includes an inclined camming surface which is engageable with a corresponding camming surface 87 on a roller housing. An opening 88 is provided in the cam plate 83 for each of the roller shafts 72.

Figure 7:
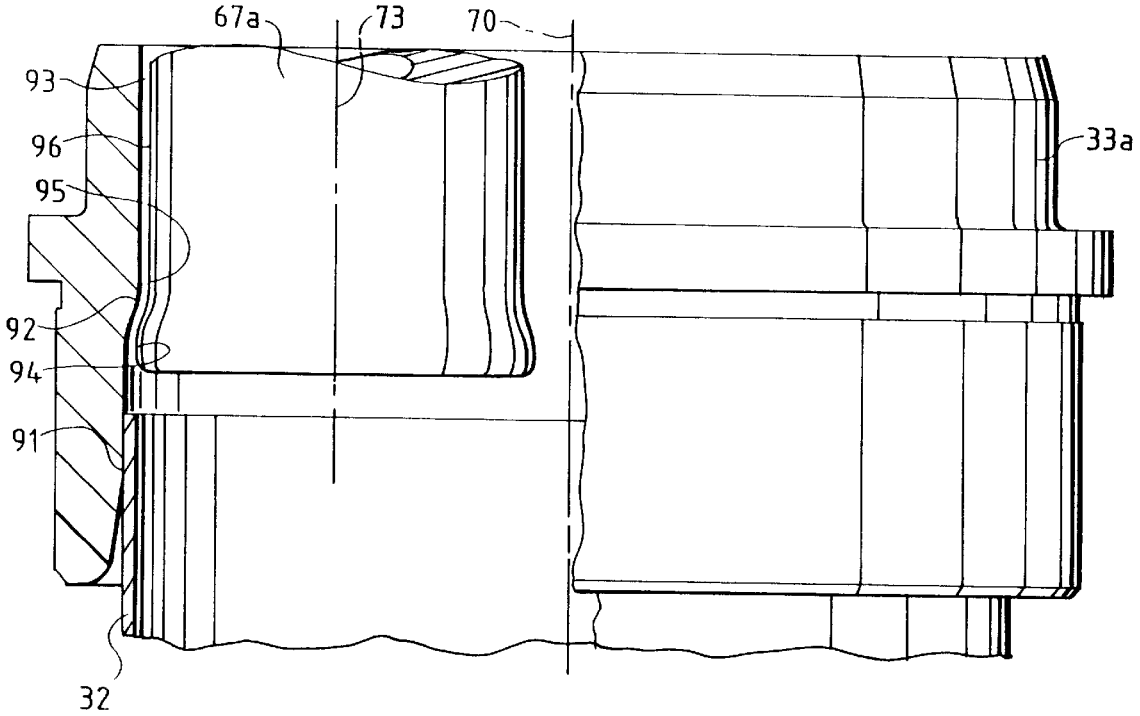
FIG. 7 is an enlarged fragmentary sectional view showing the beginning of the first necking operation.

FIG. 7 illustrates the necking die 33*a* and one of the rollers 67*a* which are used in the first necking operation. The necking die has a first substantially cylindrical wall portion 91, a tapered necking portion 92, and a second cylindrical wall portion 93. The first cylindrical wall portion 91 has an inside diameter approximately equal to the external diameter of the cylindrical container 32 with a clearance of about 0.006 inch. The wall portion 91 of the first die 33*a* may taper upwardly and inwardly at a 3° angle. The corresponding portions of subsequent dies are cylindrical. The second cylindrical wall portion 93 has a reduced diameter equal to the external diameter of the reduced neck which is formed in the first necking operation.

The roller 67*a* has a contour which corresponds to the internal contour of the necking die 33*a*. The roller includes a short generally cylindrical lower surface 94 which extends substantially parallel to the die portion 91, an inwardly tapered surface 95 which is spaced uniformly from die portion 92, and a cylindrical upper surface 96 which is parallel to die portion 93.

FIGS. 1 and 2 illustrate the actuator 51 in its lowered position. The camming surface 81 engages the camming surfaces 82 of the roller housings and moves the rollers radially outwardly so that the spacing between the rollers and the inside surface of the die is slightly greater than the thickness of the wall of the container 32 as shown in FIG. 7, for example, 0.0057 to 0.0069 inches, or more preferably 0.0059 to 0.0064 inches, for a top wall thickness of 0.0054 inches. The cams 86 engage the roller housings and act as a stop or motion limiter to maintain a precise spacing between the rollers and the die. The rollers therefore do not squeeze the container wall or force it against the die but merely guide the wall to follow the contour of the die. The spacing between the rollers and the die is preferably within the range of about 0.0003 to 0.0015 inch greater than the thickness of the container wall and more preferably within the range of about 0.0005 to 0.0010 inch greater than the thickness of the container wall.

The roller assemblies 40 are rotated around the inside of the die by the spindle 42. The rollers rotate about the longitudinal axis 70 of the spindle and effectively generate a continuous surface of revolution about that axis. The axis 70 coincides with the longitudinal axis of the die 33. The spindle is rotated by the gear 48 at a speed of about 1000 to 4000 rpm, depending upon the output of the necking apparatus.

During the necking operation, the ram 30 moves the lifter pad 29 and the container 32 upwardly into the die. The container wall first engages the cylindrical wall portion 91 of the die as illustrated in FIG. 7. The lower portions 94 of the rollers extend below the necking portion 92 of the die and act as guides for the container wall. As the container is pushed upwardly by the lifter pad, the container wall engages the necking portion 92 of the die and then moves upwardly along the cylindrical portion 93 of the die. As the container wall engages the rollers 67, each roller spins on its spinning axis 73 as the roller assemblies rotate about the common central axis 70 of the spindle 42 and the die. The spinning axis of each roller extends parallel to the common axis of the spindle and the die. The container wall is guided by the spinning and rotating rollers to follow the contour of the necking die without wrinkling or pleating.

The side wall of a drawn and ironed container conventionally includes three wall thicknesses before necking. The bottom portion of the side wall has a thickness which corresponds to the thickness of the bottom wall. The intermediate portion of the side wall is thinner. The top portion of the side wall, which is the portion which is necked, is thicker than the intermediate portion.

Figure 8:
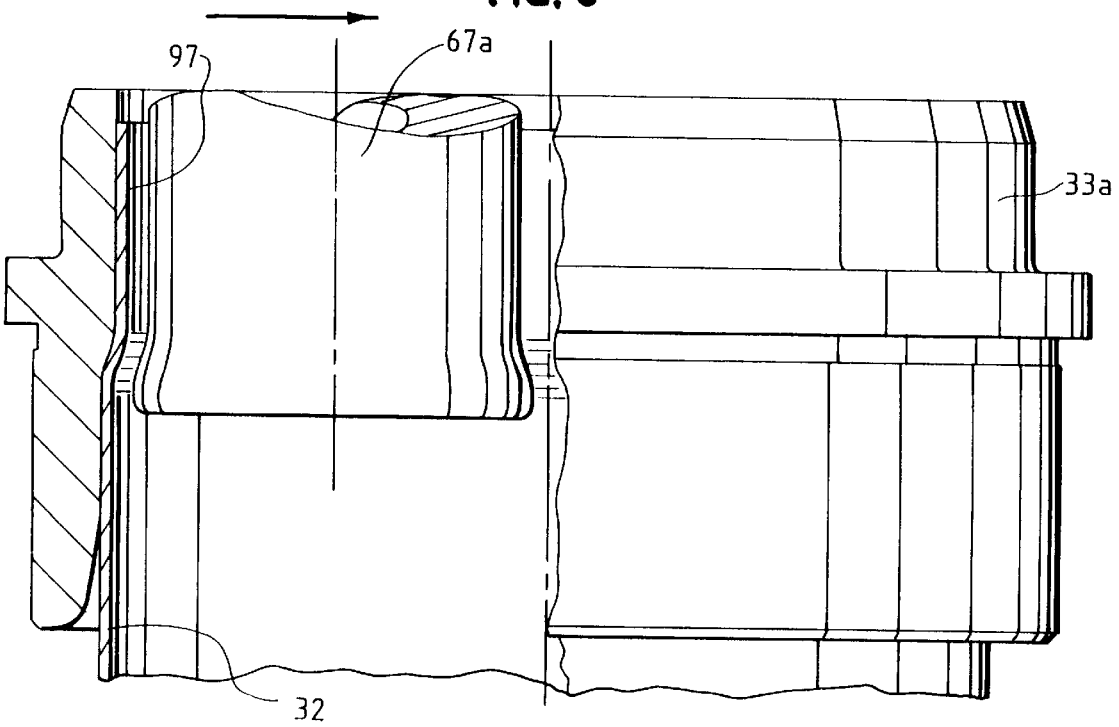
FIG. 8 is a view similar to FIG. 7 showing the completion of the first necking operation.

After the neck 97 (FIG. 8) is formed on the container, the rollers 67*a* are moved inwardly away from the inside surface of the die toward the axis of the spindle as illustrated in FIG. 8. The rollers are moved inwardly by raising the actuator 51 to a raised position. Referring to FIG. 2, as the actuator rises, the camming surface 81 of the actuator moves upwardly and allows the camming surfaces 82 on the roller housings to move inwardly. At the same time, the cams 86 on the camming plate 83 are moved upwardly by the actuator and cause the roller housings to pivot on the pivot pins 68. The openings 88 in the camming plate 83 allow the roller shafts 72 and the rollers to move away from the inside surface of the die.

After the rollers are moved inwardly, the container can be withdrawn from the die by lowering the lifter pad 29. If desired, the lifter pad can be equipped with vacuum ports which assist in holding the container on the lifter pad and in removing the container from the die.

We are currently filling the container with compressed air during the necking operation as described in the '232, '839, and '900 patents. However, we believe that the necking operation can be performed without compressed air. Further, the movable roller assemblies reduce the need for compressed air which is needed to blow the container out of the die as described in those patents. We use only about 6 psi of air to blow the container out of the die.

Figure 9:
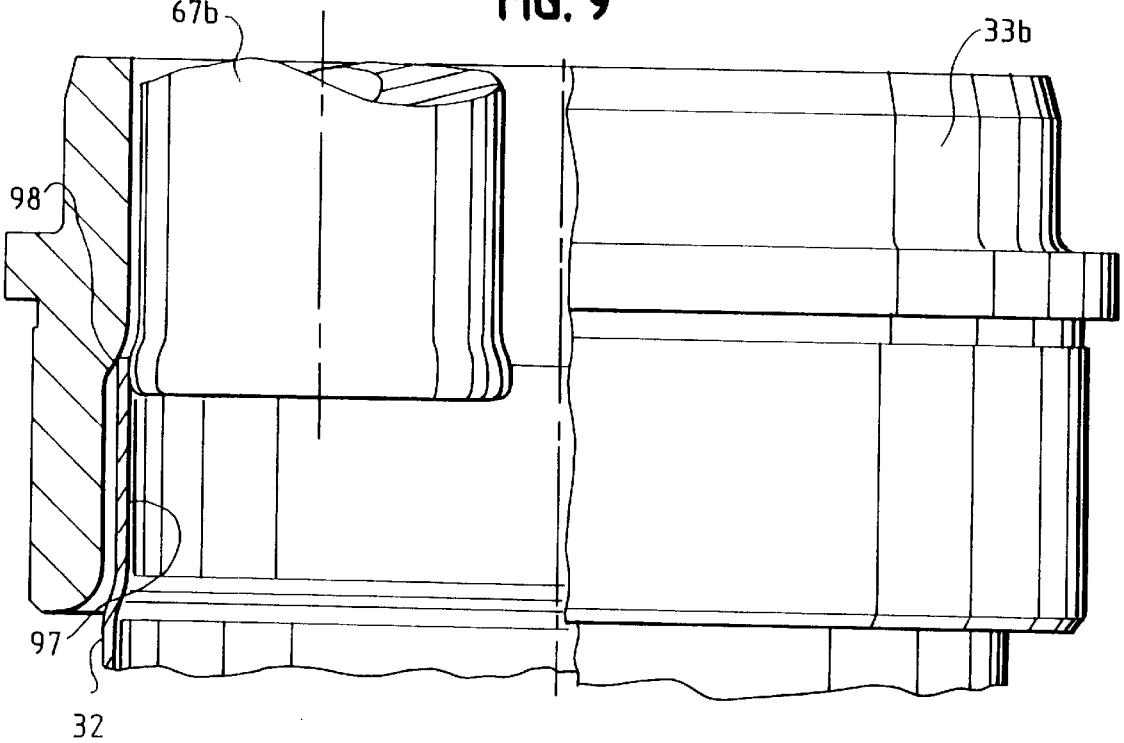
FIG. 9 illustrates the beginning of the second necking operation.
Figure 10:
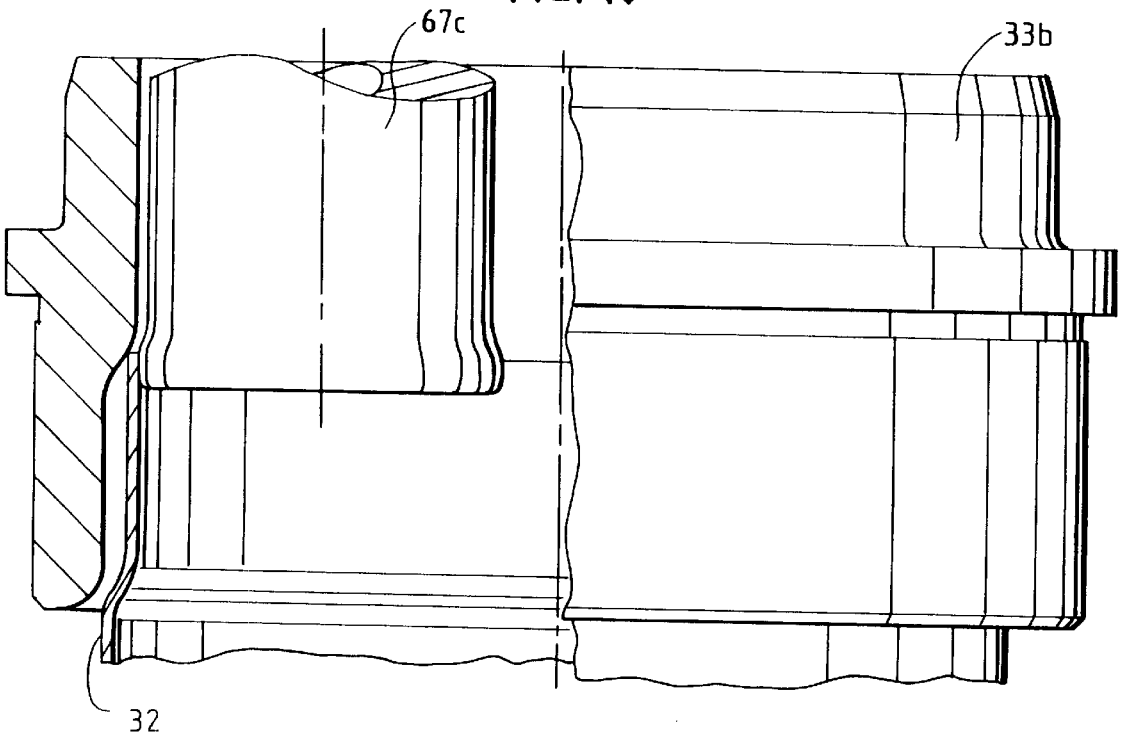
FIG. 10 illustrates the beginning of the third necking operation.
Figure 11:
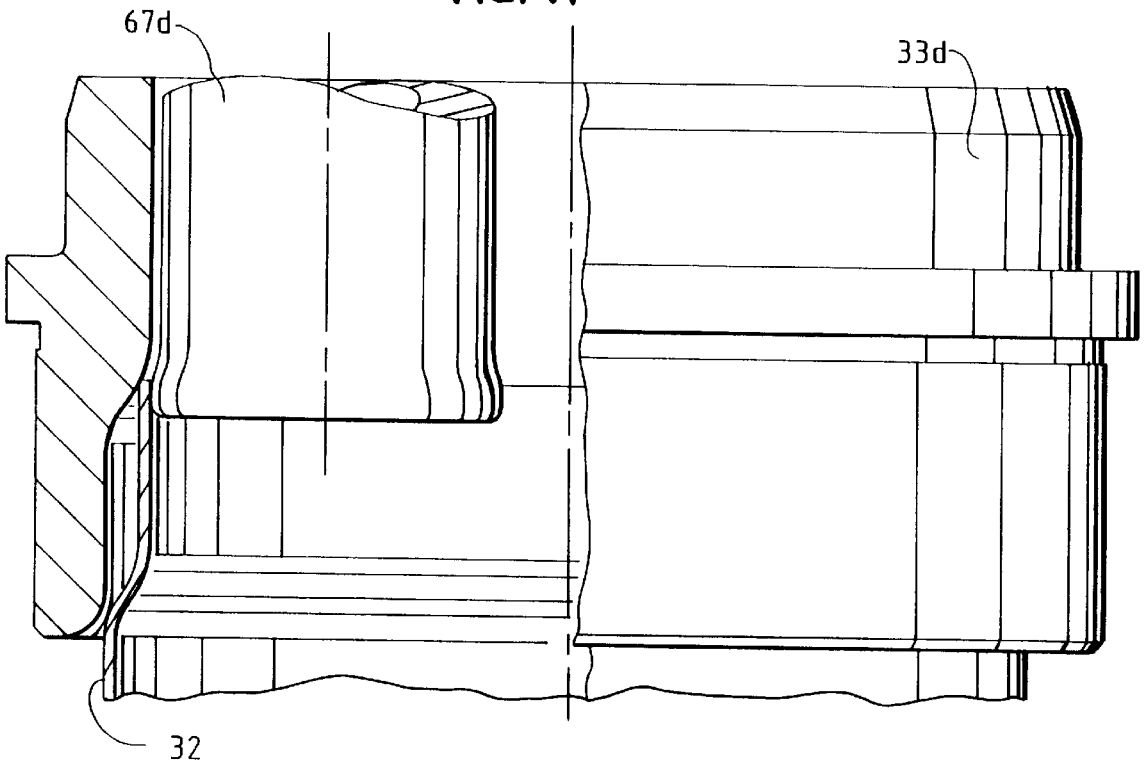
FIG. 11 illustrates the beginning of the fourth necking operation.
Figure 12:
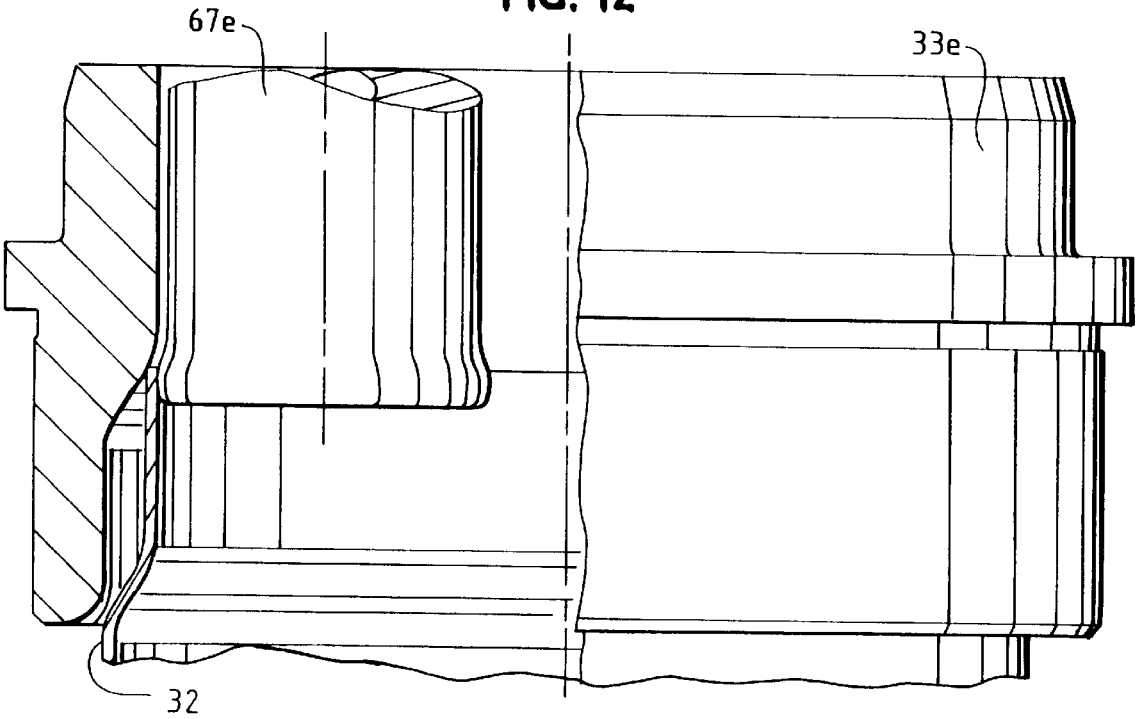
FIG. 12 illustrates the beginning of the fifth necking operation.
Figure 13:
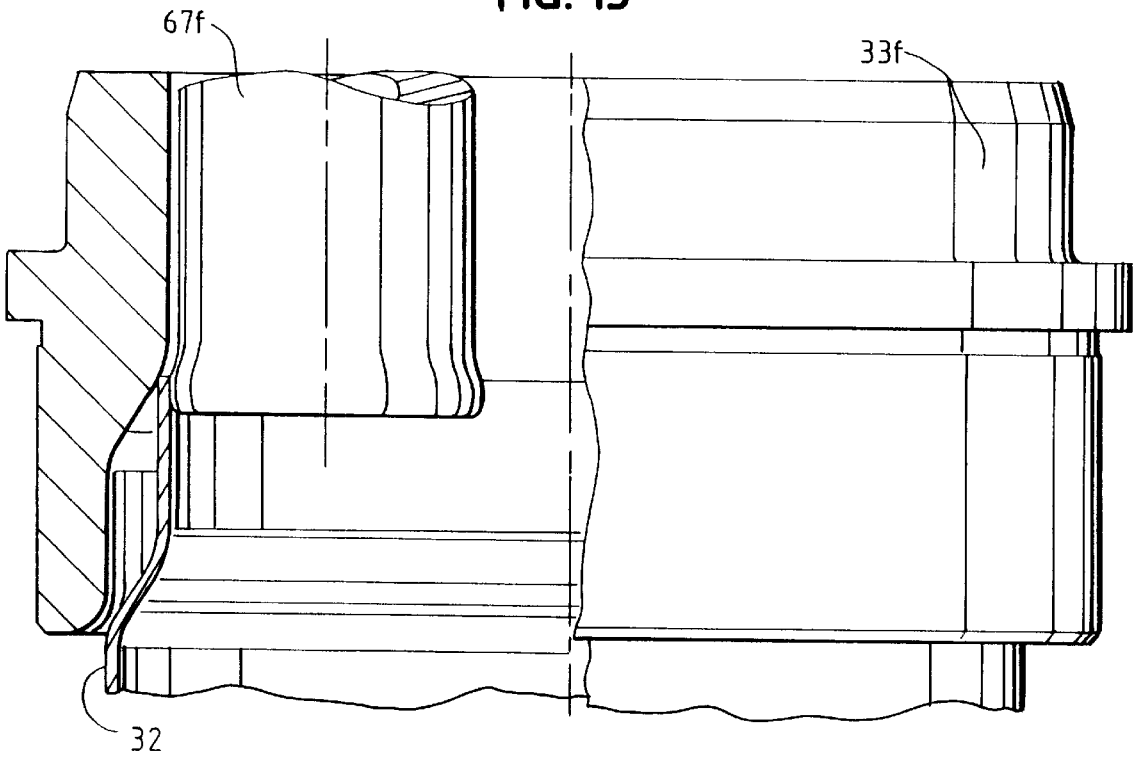
FIG. 13 illustrates the beginning of the sixth necking operation.
Figure 14:
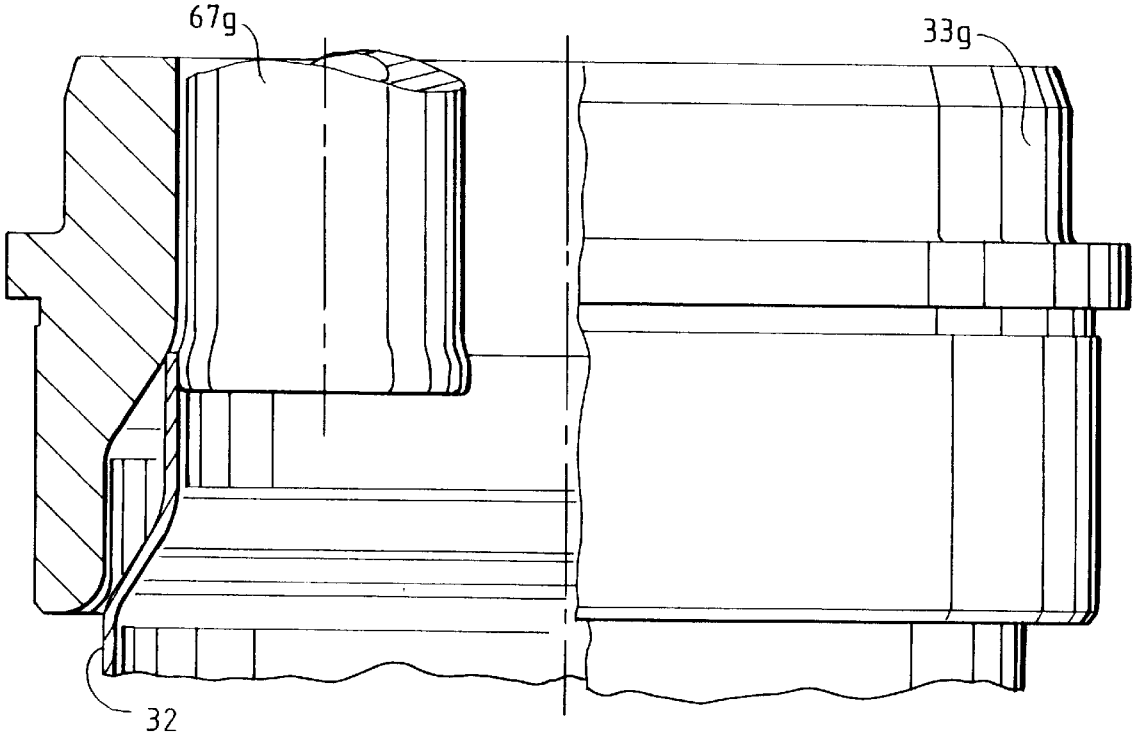
FIG. 14 illustrates the beginning of the seventh necking operation.
Figure 15:
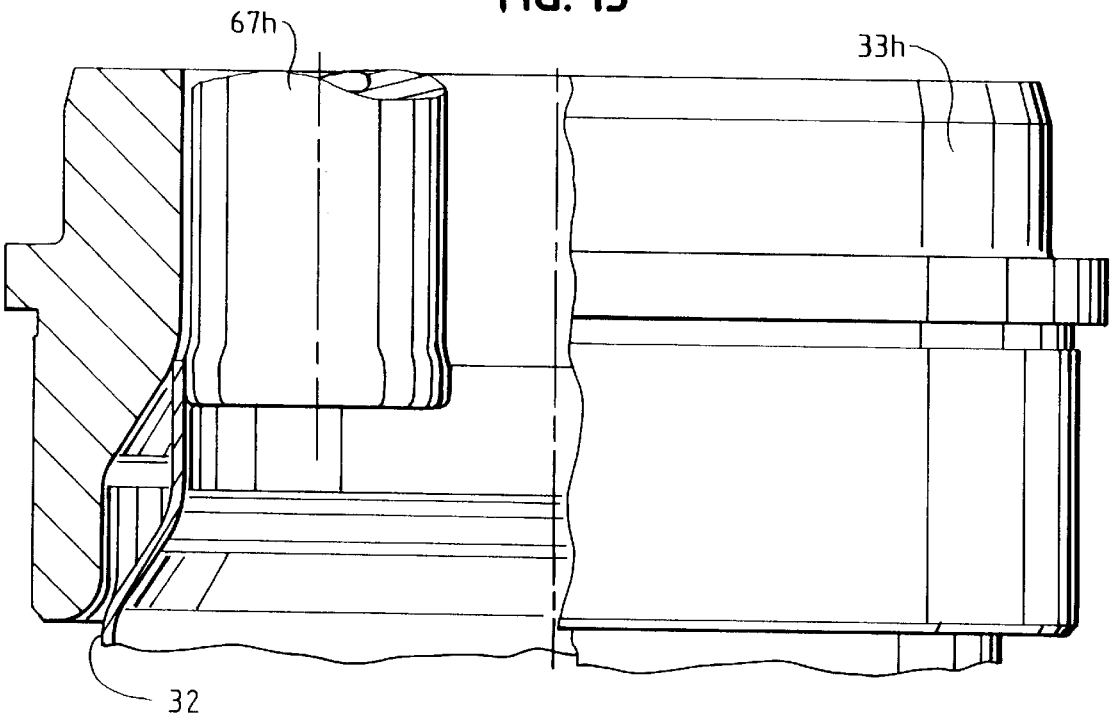
FIG. 15 illustrates the beginning of the eighth necking operation.
Figure 16:
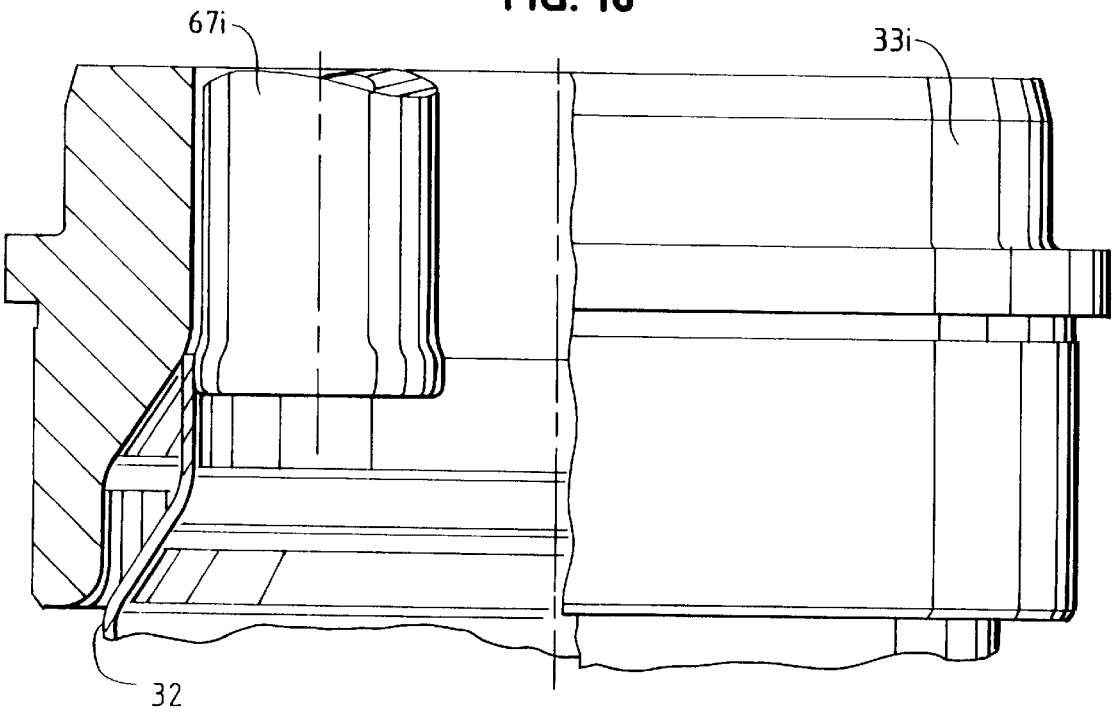
FIG. 16 illustrates the beginning of the ninth necking operation.
Figure 17:
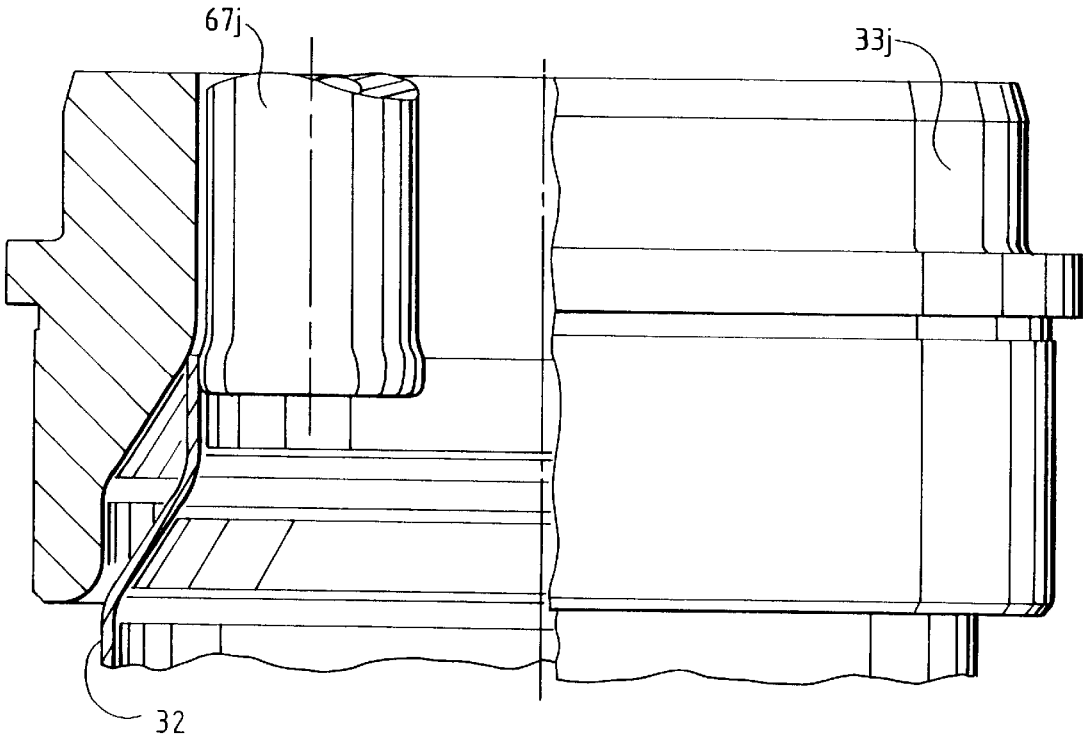
FIG. 17 illustrates the beginning of the tenth necking operation.

FIG. 9 illustrates the necking die 33*b* and one of the rollers 67*b* for the second necking operation. The die 33*b* includes a necking portion 98 which engages the neck 97 of the container 32 which was formed during the previous necking operation. The spinning and rotating rollers 67*b* guide the container wall to follow the contour of the necking die as the container is moved upwardly by the lifter pad.

FIGS. 10 through 17 illustrate subsequent necking operations which use dies 33*c–j* and rollers 67*c–j*. In each operation the die includes a necking portion which engages and reforms the neck which was formed in the preceding operation. The lower cylindrical wall of each die corresponds to the outside diameter of the container, and the upper cylindrical wall of each die corresponds to the outside diameter of the new neck.

During each necking operation the actuator 51 of the necking module is maintained in its lowered position so that the rollers are positioned adjacent the internal surface of the die to guide the container wall. After the necking operation is completed, the actuator is raised to move the rollers inwardly and to permit the container to be withdrawn from the die.

The actuator assembly of FIG. 2 includes a positive return mechanism in the form of the cam plate 83 and the cams 86 for moving the rollers inwardly after necking is completed. If desired, other return means, for example, springs, can be used for moving the rollers inwardly as the actuator 51 is raised.

Figure 4:
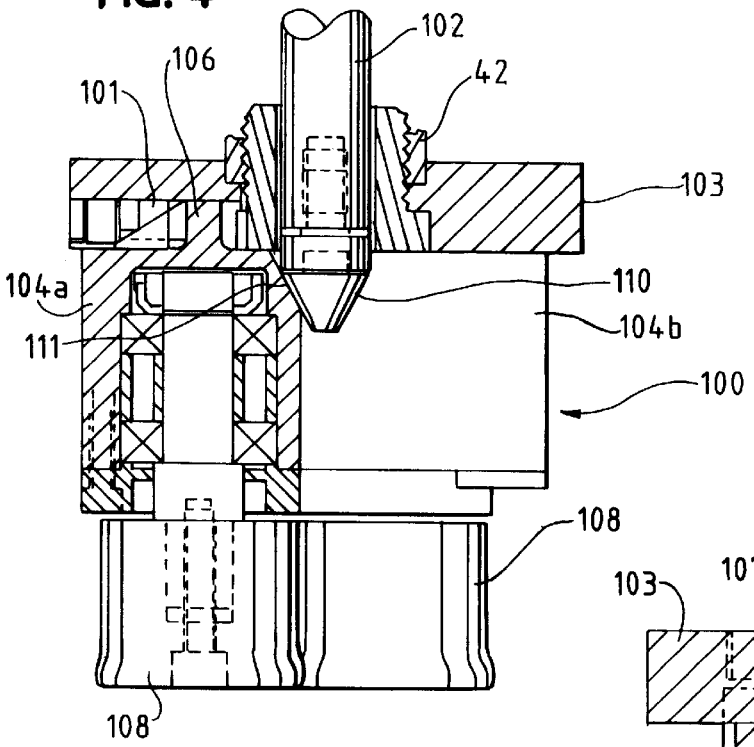
FIG. 4 is a fragmentary sectional view of modified roller assemblies.
Figure 6:
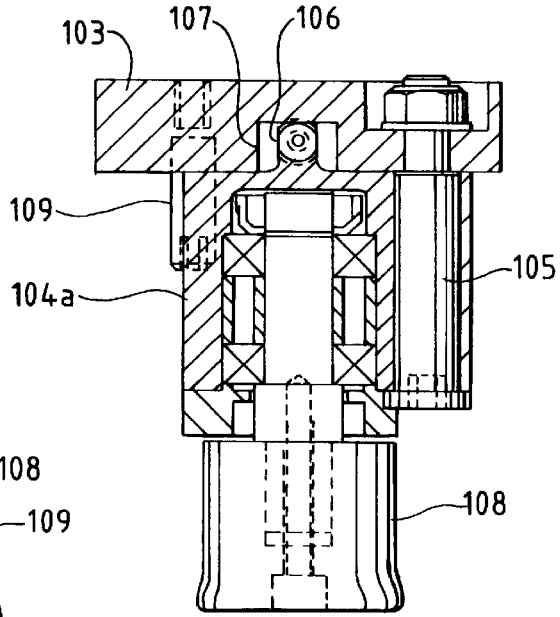
FIG. 6 is a sectional view taken along the line 6—6 of FIG. 5.
Figure 5:
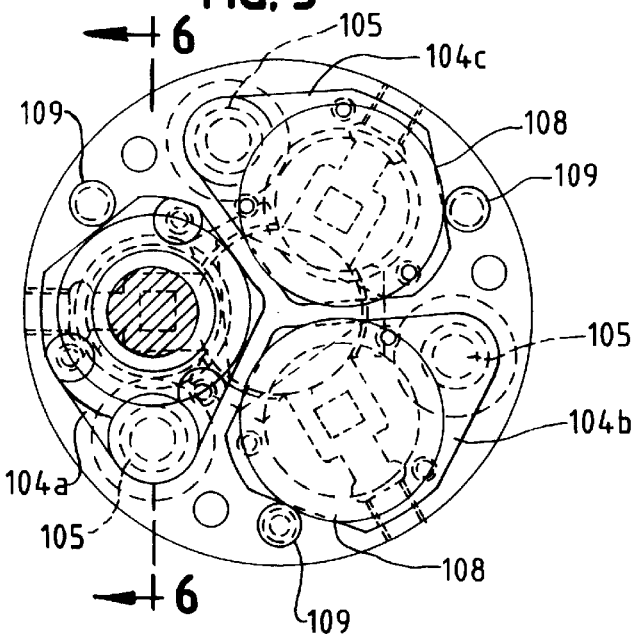
FIG. 5 is a bottom plan view, partially in section, of the roller assemblies of FIG. 4.

FIGS. 4–6 illustrate another embodiment of roller assemblies 100 which are similar to the roller assemblies 40 except that the camming plate 83 and cams 87 (FIG. 2) are not included. Instead, springs 101 are used to move the roller assemblies inwardly when the actuator 102 is raised.

A mounting plate 103 is attached to the lower end of the spindle 42. Three roller housings 104*a,* 104*b,* and 104*c* are pivotally attached to the mounting plate by pivot pins 105. A lug 106 on the top of each of the housings extends into a slot 107 in the mounting plate. A spring 101 engages each lug 106 and biases the roller housing to pivot inwardly about the pivot pin 105. A roller 108 is mounted on t he roller housing as previously described. Pins 109 limit the outward pivoting of the roller housings and precisely position the rollers relative to the inside surface of the die.

A carbide conical actuator tip 110 is mounted on the end of the actuator 102 and engages an inclined camming surface 111 on each of the roller housings. When the actuator moves down, the roller housings are cammed outwardly until they are stopped by the pins 109. When the actuator is raised after the necking operation, the springs 101 move the roller housings and rollers inwardly away from the inside surface of the die.

Figure 18:
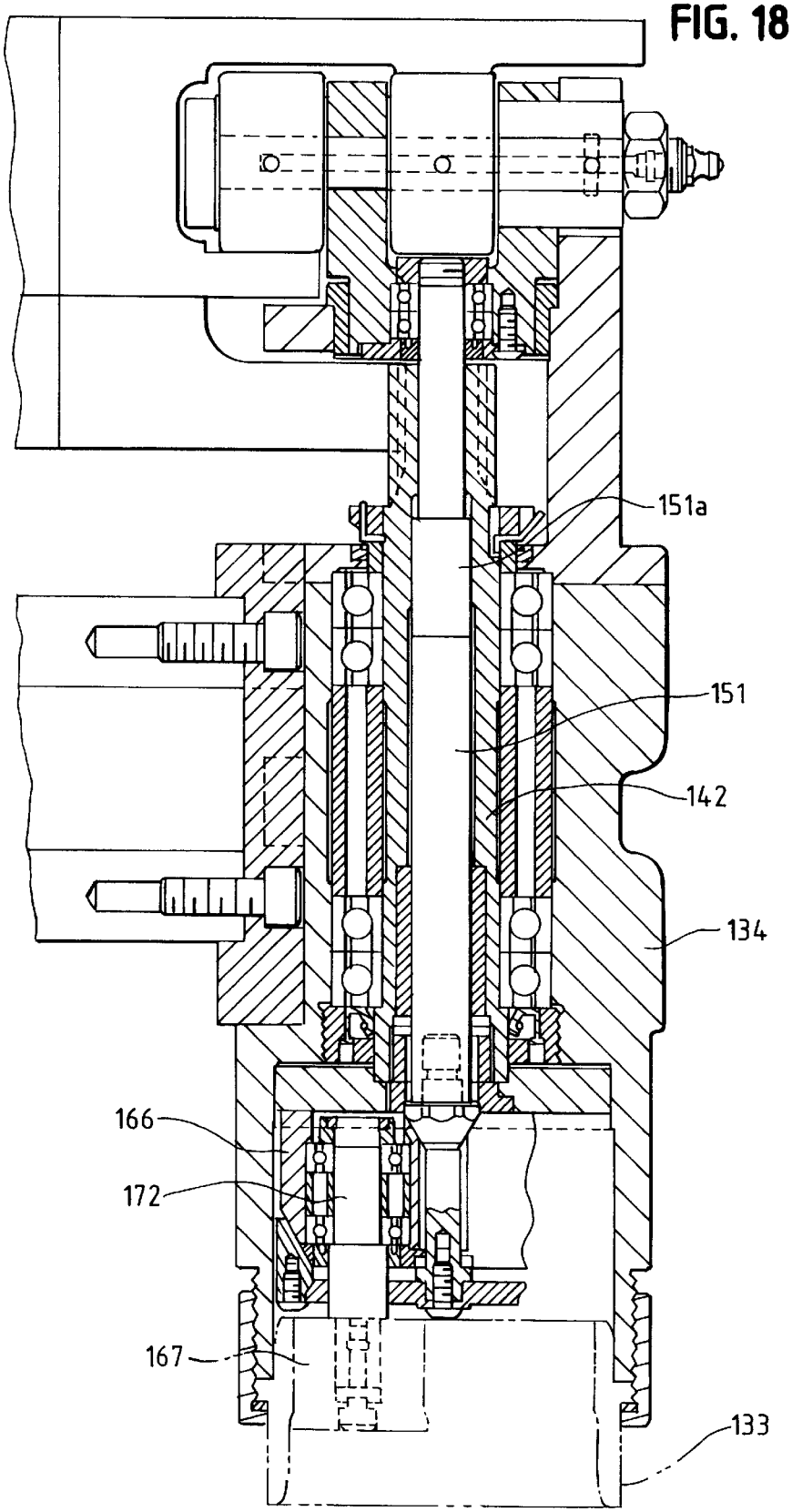
FIG. 18 is a fragmentary sectional view of another embodiment of a necking apparatus.
Figure 19:
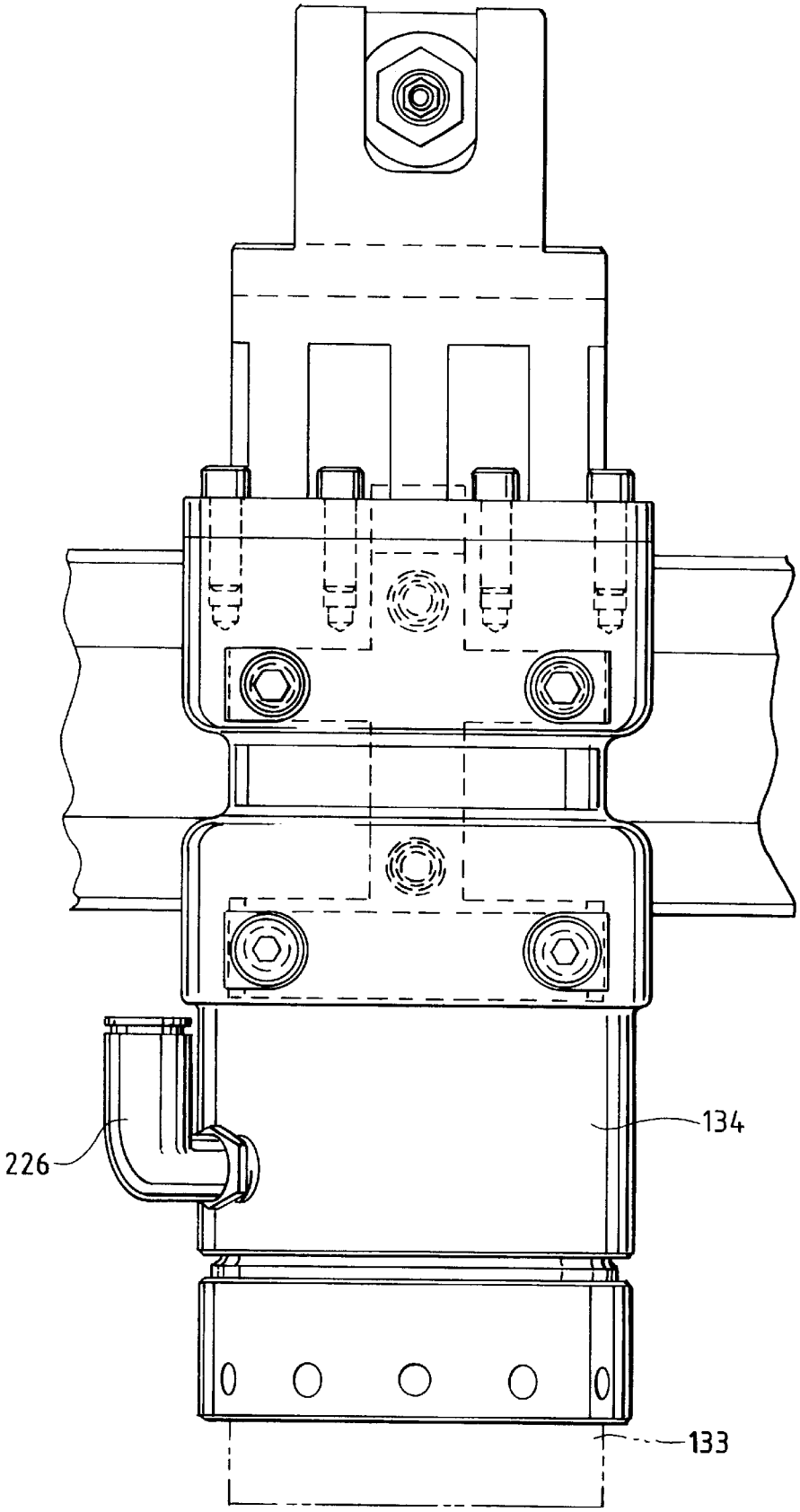
FIG. 19 is a fragmentary side view of the apparatus of FIG. 18.
Figure 20:
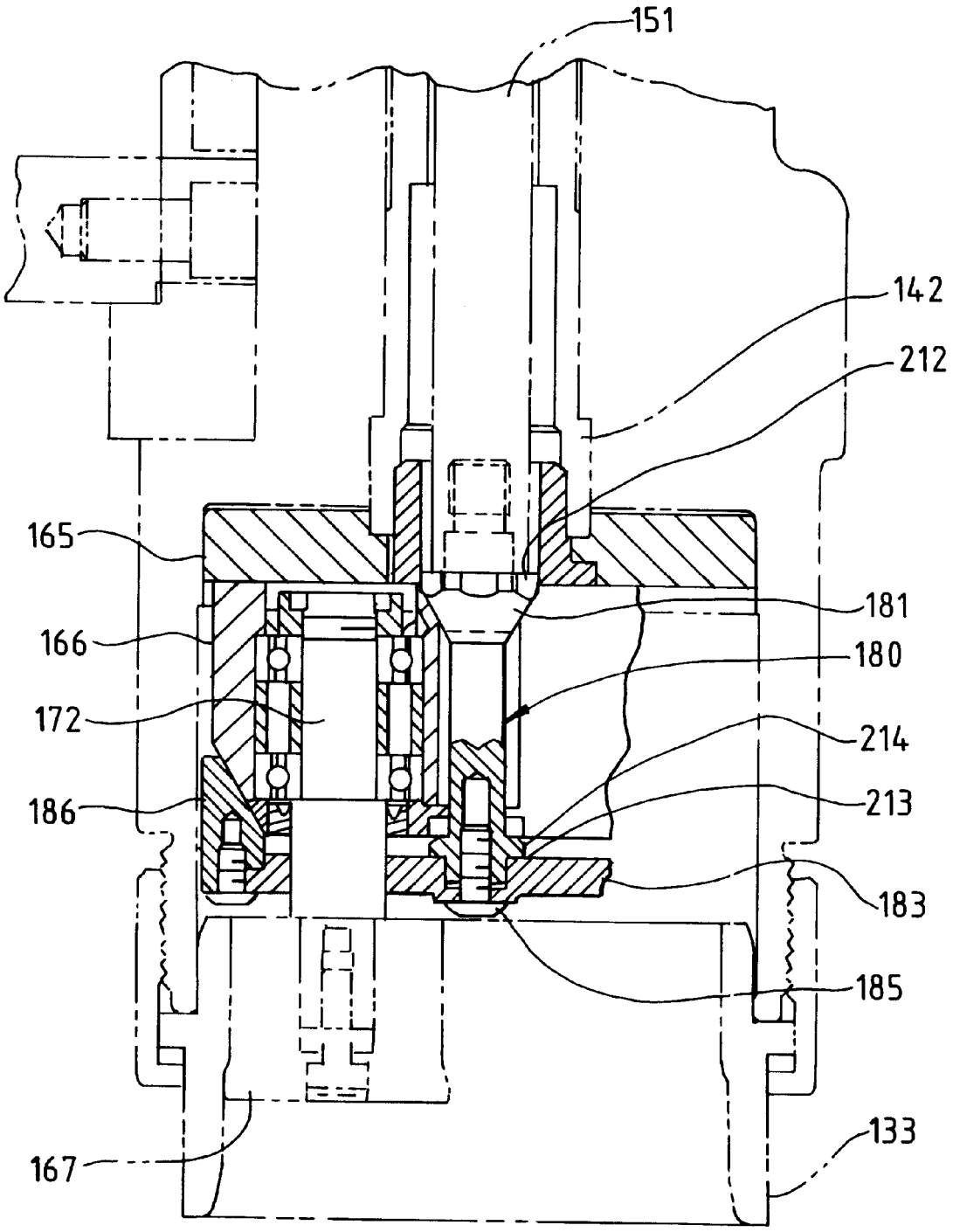
FIG. 20 is an enlarged view of the roller assembly of FIG. 18.

The currently preferred embodiment of the necking apparatus is illustrated in FIGS. 18–20. The necking apparatus of FIGS. 18–20 is very similar to the necking apparatus of FIGS. 1–6, and like parts will be identified in FIGS. 18–20 by the reference numerals of FIGS. 1–6 increased by 100. Actuator 151 is reciprocably mounted within tubular spindle 142. The actuator includes a hexagonal portion 151*a* which slides within a correspondingly shaped female hexagonal portion of the spindle to ensure that the actuator rotates with the spindle to prevent friction between the actuator and the roller housings 166.

A mounting plate 165 is attached to the spindle 142, and the roller assemblies 166 are pivotally mounted on the mounting plate as previously described. A camming pin 180 is screwed into the bottom of the actuator 151, and the conical camming surface 181 is spaced from the lower end of the actuator by a shim 212.

Cam plate 183 is attached to the lower end of the camming pin 180 by a screw 185, and the distance between the camming plate 183 and the camming surface 181 is precisely controlled by a shim 213 which is positioned between the cam plate 183 and a shoulder 214 on the camming pin 180. A cam 186 is mounted on the cam plate 183 for each of the roller housings.

The shims 212 and 213 are precisely ground for each necking apparatus. The cams 186 act as stops to limit the outward movement of the rollers 167, and the shim 213 spaces the cam plate 183 and the cams 186 from the conical camming surface 181 to adjust the outer position of the rollers 167. The spacing between the rollers 167 and the inside surface of the die 133 is thereby precisely controlled for each necking apparatus.

The shim 212 is used to adjust the inner positions of the rollers when the actuator 151 is raised. Changing the thickness of the shim changes the inner position of the rollers.

Figure 21:
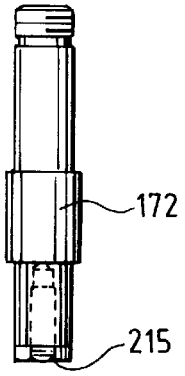
FIG. 21 is an elevational view of the roller shaft of FIG. 18.
Figure 22:
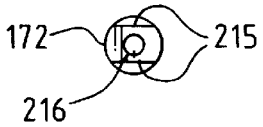
FIG. 22 is a bottom view of the roller shaft of FIG. 21.
Figure 23:
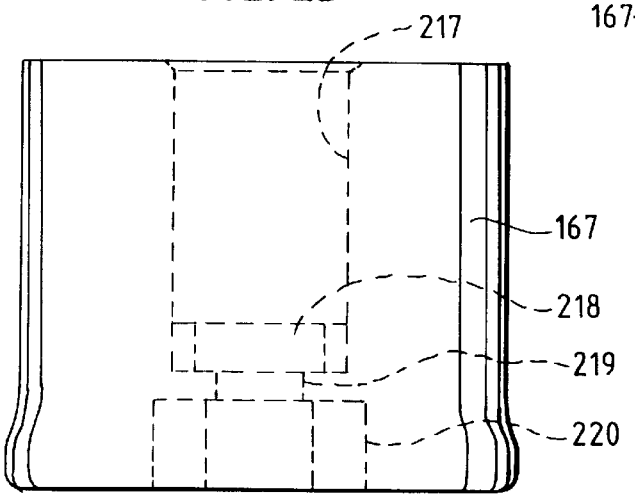
FIG. 23 is an elevational view of the roller of FIG. 18.
Figure 24:
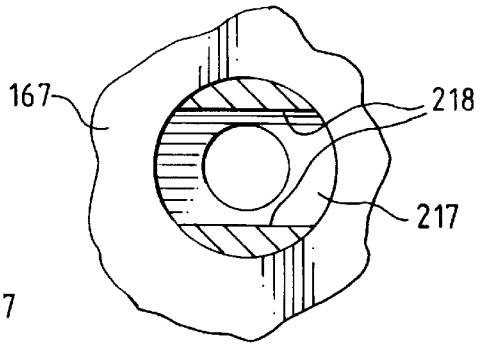
FIG. 24 is a top view of the roller of FIG. 23.
Figure 25:
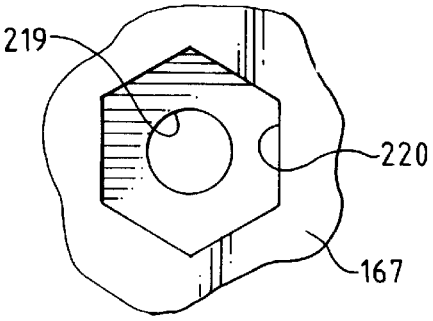
FIG. 25 is a bottom view of the roller of FIG. 23.

The roller 167 are non-rotatably mounted on rollers shafts 172. Referring to FIGS. 21 and 22, the lower end of each shaft 172 includes a pair of parallel flats 215 and a threaded opening 216. Referring to FIGS. 23–25, each roller includes a cylindrical bore 217 for the shaft 172, and the lower end of each bore includes shoulders 218 which non-rotatably engage the flats 215 on the shaft.

Figure 27:
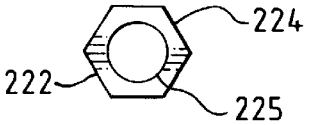
FIG. 27 is a top view of the wrench of FIG. 26.
Figure 26:
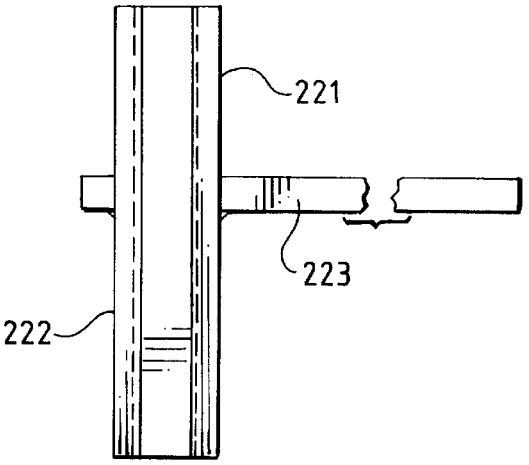
FIG. 26 is an elevational view of a wrench for securing the roller to the shaft.

The roller is attached to the shaft by a cap screw (not shown) which extends through an opening 219 in the roller and into the threaded opening 216 of the shaft. In order to hold the roller while the cap screw is threaded into the shaft, the roller is provided with a hexagonal female recess 220. An Allen wrench 221 (FIGS. 26–27) includes a tubular wrench portion 222 and a handle 223. The wrench portion 222 includes a hexagonal outer surface 224 and a cylindrical internal bore 225. The hexagonal external surface of the wrench is inserted into the hexagonal female recess 220 of the roller, and the cap screw is inserted through the bore 225 of the wrench and the bore 219 of the roller. A screwdriver can be inserted through the bore 225 of the wrench to tighten the screw.

Pressurized air is supplied to the can through a fitting 226 (FIG. 19) which extends through the tubular housing 134.

The foregoing necking apparatus permits necking thin container walls, for example, having a thickness of 0.0054 inch or less, in 10 necking operations rather than 16 necking operations without forming wrinkles or pleats. The use of a thinner wall, either along the entire height of the container or in the top wall portion of the container which forms the neck reduces the amount of material which is needed to make the container. The apparatus is particularly useful in necking two piece drawn and ironed cans down to a 202 diameter.

While in the foregoing specification a detailed description of specific embodiments of the invention was set forth, it will be understood that many of the details herein given can be varied considerably by those skilled in the art without departing from the spirit and scope of the invention.

We claim:

1. A die assembly for necking an open end of a container wall comprising:

a housing having upper and lower ends, a die mounted on the lower end of the housing and having a central axis and an inside surface, a spindle rotatably mounted in the housing, the spindle having upper and lower ends and a central axis which is aligned with the axis of the die, a mounting member attached to the lower end of the spindle for rotation therewith, a roller housing pivotally mounted on the mounting member for pivoting movement about an axis which extends parallel to the axis of the spindle, a roller rotatably supported by the roller housing adjacent the inside surface of the die, the roller being rotatable about an axis which extends parallel to the axis of the spindle, an actuator for pivoting the roller housing away from the axis of the spindle whereby the roller is moved toward the inside surface of the die, and a stop for limiting pivoting movement of the roller housing toward the die whereby a constant gap is maintained between the roller and the inside surface of the die.

2. The die assembly of claim 1 in which the stop is adjustable so that said gap may be varied.

3. The die assembly of claim 1 in which said actuator is reciprocably mounted within the spindle for movement between first and second positions.

4. The die assembly of claim 1 in which the actuator and the roller housing include cooperating camming surfaces for moving the roller housing as the actuator moves from its first position to its second position.

5. The die assembly of claim 4 including a second member on the housing for moving the actuator from it s second position to its first position.

6. The die assembly of claim 1 including a first member on the housing for moving the actuator from its first position to its second position.

7. The die assembly of claim 1 in which said stop comprises a cam attached to the actuator below the roller housing, the cam being engageable with the roller housing as the roller housing moves away from the axis of the spindle.

8. The die assembly of claim 7 in which the cam is mounted on a plate which extends below the roller housing and which is attached to the actuator, the cam extending upwardly from the plate toward the roller housing.

9. The die assembly of claim 8 in which the plate is provided with an opening for the roller, the roller being attached to a shaft which extends through the opening in the plate and which is rotatably mounted in the roller housing.

10. The die assembly of claim 8 including a second cam attached to the actuator, the second cam including a camming surface for moving the roller housing as the actuator moves from its first position to its second position, the cam plate being attached to the second cam, the spacing between the cam plate and the camming surface of the second cam being adjustable whereby said gap can be adjusted.

11. The die assembly of claim 10 in which the actuator includes a lower end, the second cam extending from the lower end of the actuator, and means for adjusting the spacing between the camming surface of the second cam and the lower end of the actuator.

12. The die assembly of claim 1 in which said gap is within the range of about 0.0003 to about 0.0015 inch greater than the thickness of the container wall.

13. The die assembly of claim 1 in which said roller has an outer surface portion which is substantially parallel to the inside surface of the die.

14. A method of necking an open end of a container wall comprising:

pivotally mounting a roller assembly inside of a die having an inside necking surface and a central axis, the roller assembly being mounted for pivoting movement about an axis which extends parallel to the axis of the die and being pivotable toward and away from the necking surface of the die, the roller assembly including a rotatable roller which is rotatable about an axis which extends parallel to the axis of the die and which has an outer surface portion which extends parallel to the necking surface of the die, positioning a stop member for limiting pivoting movement of the roller assembly toward the necking surface of the die whereby a constant gap is maintained between the outer surface portion of the roller and the necking surface, pivoting the roller assembly toward the necking surface of the die and into contact with the stop member to provide said gap, rotating the roller assembly about an axis which is aligned with the axis of the die while maintaining said gap, and inserting an open end of a container wall into said gap while the roller assembly is rotating.

15. The method of claim 14 including the steps of moving the roller assembly away from the necking surface of the die after the open end of the container wall is necked, and removing the container wall from the die.

16. The method of claim 14 in which the open end of the container has a thickness of about 0.0054 inch or less.

17. The method of claim 16 in which said gap is within the range of about 0.0003 to about 0.0015 inch greater than the thickness of the container wall.

18. The method of claim 16 in which said gap is within the range of about 0.0005 to about 0.0010 inch greater than the thickness of the container wall.

19. The method of claim 14 in which said gap is thicker than the open end of the container wall.

20. A die assembly for necking an open end of a container wall comprising:

a housing having upper and lower ends, a die mounted on the lower end of the housing and having a central access and an inside surface, a spindle rotatably mounted in the housing, the spindle having upper and lower ends and a central axis which is aligned with the axis of the die, a mounting member attached to the lower end of the spindle for rotation therewith, a plurality of roller housings pivotally mounted on the mounting member for pivoting movement about axes which extend parallel to the axis of the spindle, a roller rotatably supported by each of the roller housings adjacent the inside surface of the die, each roller being rotatable about an axis which extends parallel to the axis of the spindle, an actuator for pivoting the roller housings away from the axis of the spindle whereby the rollers are moved toward the inside surface of the die, and a stop for limiting pivoting movement of each of the roller housings toward the die whereby a constant gap is maintained between each of the rollers and the inside surface of the die.

* * * * *